United States Patent [19]

Swenson

[11] 4,407,474

[45] Oct. 4, 1983

[54] PLASTIC SACK HOLDER

[75] Inventor: Rita Swenson, Ringwood, N.J.

[73] Assignee: International Paper Company, New York, N.Y.

[21] Appl. No.: 296,946

[22] Filed: Aug. 28, 1981

[51] Int. Cl.[3] ..... A63B 55/04

[52] U.S. Cl. ..... 248/97; 248/99

[58] Field of Search ..... 248/97, 99, 100, 95, 248/101; 53/390; 141/390

[56] References Cited

U.S. PATENT DOCUMENTS

| | | | |
|---|---|---|---|
| 1,005,956 | 10/1911 | Gibbons . | |
| 1,057,240 | 3/1913 | Hildreth . | |
| 1,078,083 | 11/1913 | Blood | 246/99 |
| 1,103,370 | 7/1914 | Moore . | |
| 1,265,996 | 5/1918 | Cerny | 248/99 |
| 1,307,439 | 6/1919 | Farnsworth et al. | 248/99 |
| 1,431,726 | 10/1922 | Cupples . | |
| 1,455,536 | 5/1923 | Lebherz . | |
| 1,502,597 | 7/1924 | Taylor | 248/97 |
| 1,679,450 | 8/1928 | Thompson . | |
| 1,699,188 | 1/1929 | Granberg . | |
| 1,700,248 | 1/1929 | Wolfe . | |
| 2,062,023 | 11/1936 | Gosselin | 248/99 |
| 3,140,070 | 7/1964 | Doebele | 248/97 |
| 3,142,465 | 7/1964 | Hellner | 248/99 |
| 3,161,391 | 12/1964 | Bahnsen | 248/99 |
| 3,313,504 | 4/1967 | Stoltze | 248/99 |
| 3,374,976 | 3/1968 | Kurlander | 248/97 |
| 3,388,882 | 6/1968 | Burroughs et al. | 248/97 |
| 3,468,100 | 9/1969 | Rubel | 53/189 |
| 3,512,338 | 5/1970 | Nestler | 53/390 |
| 3,552,697 | 1/1971 | Pinto | 248/97 |
| 3,605,383 | 9/1971 | Piazze | 53/385 |
| 3,664,622 | 5/1972 | Vaccaro | 248/95 |
| 3,678,652 | 7/1972 | Panasewicz | 53/385 |
| 3,687,408 | 8/1972 | Lake | 248/97 |
| 3,707,826 | 1/1973 | Cole | 53/384 |
| 3,715,854 | 2/1973 | Smith et al. | 53/29 |
| 3,727,374 | 4/1973 | Williams | 53/189 |
| 3,737,129 | 6/1973 | Foster | 248/97 |
| 3,747,298 | 7/1973 | Lieberman | 53/390 |
| 3,826,455 | 7/1974 | O'Donnell | 248/97 |
| 3,840,092 | 10/1974 | Close | 186/1 AC |
| 3,869,065 | 3/1975 | Wang | 221/40 |
| 3,902,570 | 9/1975 | Close | 186/1 AC |
| 4,020,618 | 5/1977 | Benzon-Peterson et al. | 53/390 |
| 4,062,170 | 12/1977 | Orem | 53/390 |
| 4,106,734 | 8/1978 | Walitalo | 53/390 X |
| 4,316,591 | 2/1982 | Muraoka | 248/97 |
| 4,332,361 | 6/1982 | McClellan | 248/99 X |

FOREIGN PATENT DOCUMENTS

| | | | |
|---|---|---|---|
| 1936742 | of 0000 | Fed. Rep. of Germany . | |
| 2002732 | 8/1970 | Fed. Rep. of Germany | 248/100 |
| 120020 | 10/1970 | Norway | 248/100 |
| 598057 | 11/1977 | Switzerland . | |

*Primary Examiner*—J. Franklin Foss
*Attorney, Agent, or Firm*—Richard J. Ancel

[57] ABSTRACT

The present invention is directed to a device to hold open for loading a limp plastic sack having a body portion terminating in a base and a pair of integral handles. It comprises a horizontally disposed base member; a pair of oppositely-disposed, upwardly-projecting side wall members, each of which is attached at its lower end to the base member; an upwardly projecting rear wall member, wherein each vertical edge of the rear wall member is attached to a vertical edge of each of the side wall members; and means to engage the handles of the plastic sack. These means comprise a pair of spaced-apart ears projecting above the upper edges of each of the side wall members, wherein the space between the ears extends downwardly into each of the side wall members. The space between the ears, including the downward extension thereof, is of sufficient width to permit the insertion of several human fingers therein. Preferably, the height of each side wall member is slightly smaller than the height of the plastic sack to be loaded therein, and the internal perimeter of the base member is at least equal to or slightly greater than the perimeter of the base of the plastic sack when the sack is in an open position ready for loading.

8 Claims, 7 Drawing Figures

PLASTIC SACK HOLDER

BACKGROUND OF THE INVENTION

This invention relates to a device to hold open for loading a limp plastic sack having a pair of integral handles.

In an effort to reduce overhead costs, many retail establishments, such as supermarkets, are using, or are considering using, semi-automated systems at the checkout counter. Such systems can eliminate the need for both a cashier and a packer because they permit the cashier not only to charge each article, but to package same immediately thereafter in an opened grocery bag. Such systems involve the use of electronic scanning devices that "read" coded labels printed on each item. Generally, such semi-automated systems work as follows: the cashier picks up the article to be charged, registers its price by passing its coded label by a scanning device, and places it in a grocery sack.

One method of packaging such items involves the use of thin, plastic sacks. In certain markets, such sacks are becoming more popular than traditional paper grocery sacks because they eliminate the need for double bagging, and they are more moisture resistant than paper sacks. However, these sacks are fabricated from thin, plastic materials and, unlike paper sacks, are incapable of supporting themselves when opened. Hence, devices which will hold such plastic sacks open for loading are needed if the cashier is also to serve as a packer.

One sack holder is illustrated in U.S. Pat. No. 4,062,170, which shows a holder having upwardly projecting elongated tabs at the upper end of a pair of side walls, each of said tabs having rearward projections. According to the disclosure therein, a plastic sack having a pair of handles is opened, and the handle openings are then placed over the rearwardly projecting portions of the elongated tabs. It has been found, however, that this device has certain drawbacks because the groceries, when fully loaded, cause downward pressure to be exerted on the walls of the sack, which, in turn, exerts downward pressure on the sack handles. Hence, when the cashier attempts to remove the handles from the upward and rearward projections, it may be necessary for him or her to lift the fully loaded sack of groceries to disengage it from the device.

SUMMARY OF THE INVENTION

The present invention is directed to a device to hold open for loading a limp plastic sack having a pair of integral handles and a body portion terminating in a base portion. The device comprises a horizontally-disposed base member; a pair of oppositely-disposed, upwardly-projecting side wall members, each of which is attached at its lower end to the base member; an upwardly projecting rear wall member, wherein each vertical edge of the rear wall member is attached to a vertical edge of each of the side wall members; and means to engage the handles of the plastic sack. These engaging means comprise a pair of spaced-apart ears projecting above the upper edges of each of the side wall members, wherein the space between the ears extends downwardly into each of the side wall members. The space between the ears, including the downward extension thereof, is of sufficient width to permit the insertion of several human fingers therein. Preferably, the height of each side wall member is slightly smaller than the height of the plastic sack to be loaded therein, and the internal perimeter of the base member is at least equal to or slightly greater than the perimeter of the base of the plastic sack when the sack is in an open position and ready to be loaded.

The full nature of the invention will be understood from the accompanying drawings and the following description and claims. It should be understood, however, that references in the following description to base, rear, and side wall members are for convenience of description, and such terms are not intended to be used in a limiting sense.

DETAILED DESCRIPTION OF THE INVENTION

Figure 1:
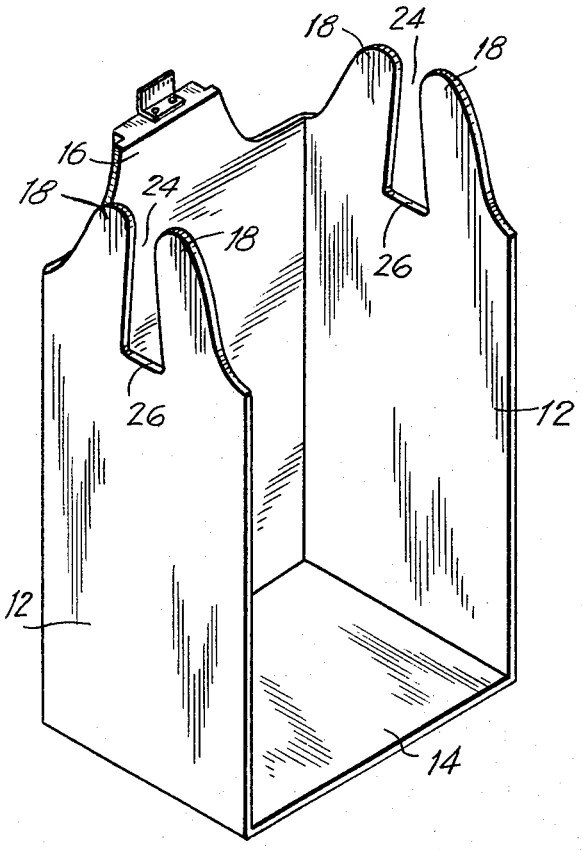
FIG. 1 is a plan view of the device of this invention.

An embodiment of the device of the present invention is depicted in FIG. 1 of the drawings. As illustrated therein, it comprises a horizontally disposed base member or bottom wall 14; a pair of oppositely disposed, upwardly projecting side wall members 12, each of which is attached at its lower end to base member 14; an upwardly projecting rear wall member 16, wherein each vertical edge of rear wall member 16 is attached to a vertical edge of each of the side wall members 12; and means 18 to engage the handles of a limp plastic sack, said means comprising a pair of spaced apart ears 18 projecting above the upper edges of each of the side wall members 12. Between ears 18 is space 24, which extends downwardly uninterruptedly into each of the side wall members 12 into an area 26. Space 24 and area 26 are each of sufficient width to permit the insertion of several fingers therein.

Figure 2:
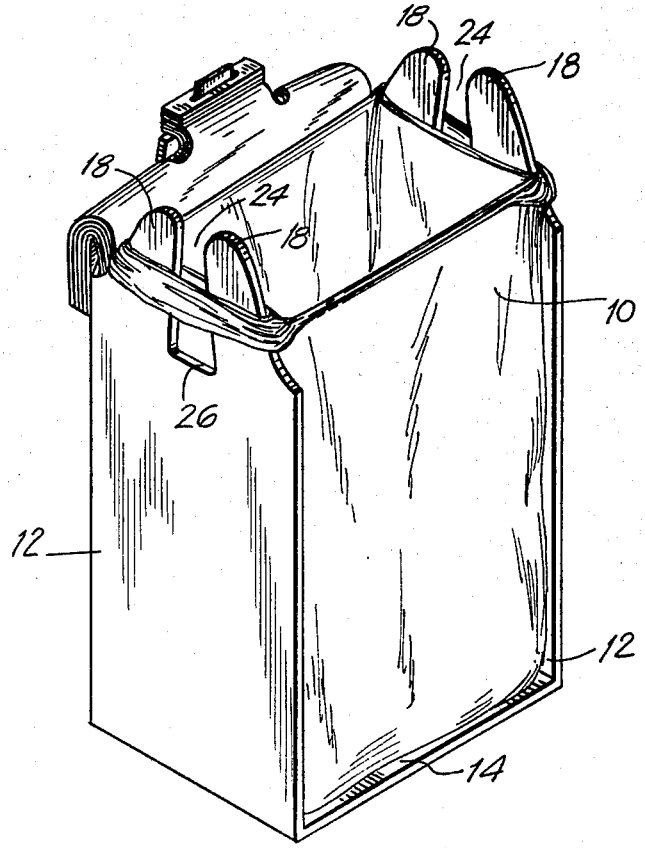
FIG. 2 is a plan view of the device shown in FIG. 1 with a plastic sack disposed therein ready for loading.
Figure 3:
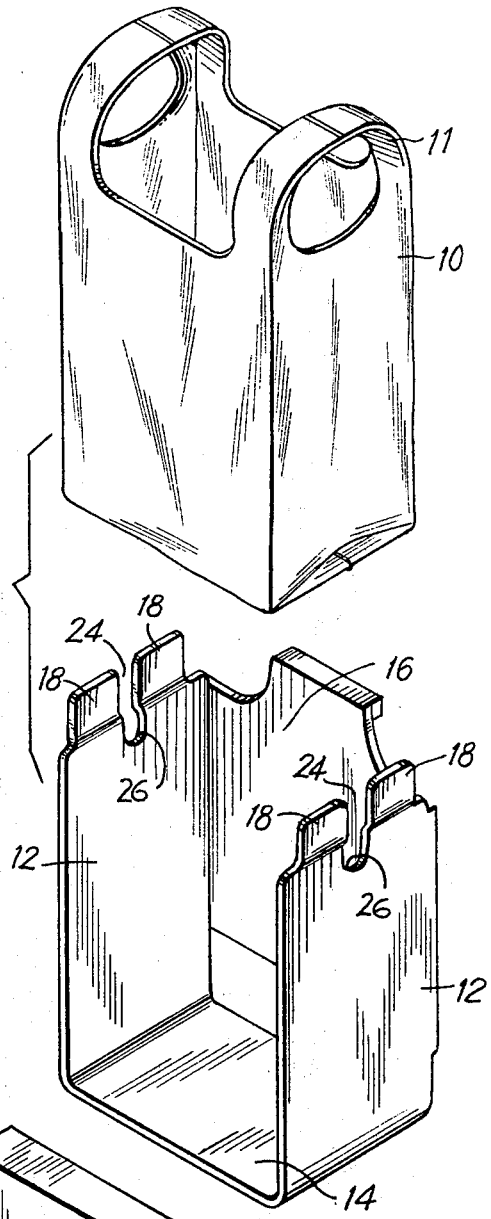
FIG. 3 is a perspective view of a preferred embodiment of the device and a sack about to be loaded therein.

A plastic sack that is suitable for use with the device of this invention is illustrated in FIGS. 2 and 3. It consists of a pair of integral handles 11 and a body portion 10 terminating in a base portion. In the trade, it is known as a "T-shirt sack," in view of its configuration. Preferably, the sack is formed from a gusseted, flattened tube of thermoplastic material, such as polyethylene. Thus, the handles 11 are also gusseted, and this provides a double thickness handle for strength. Although such sacks are manufactured in a variety of sizes, the size of a typical grocery sack is designated as one-sixth of a barrel.

Figure 4:
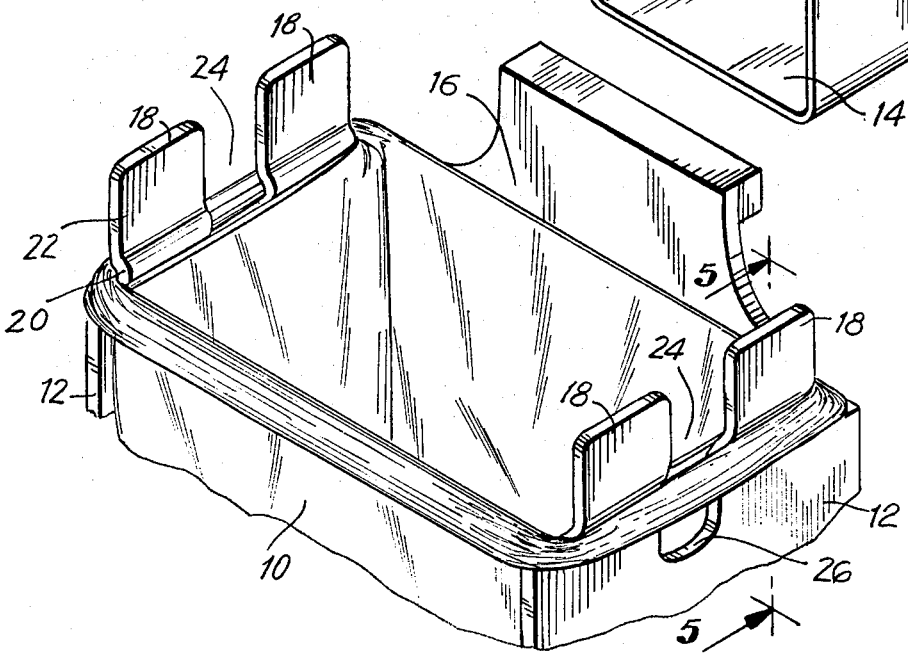
FIG. 4 is a view of the plastic sack in the preferred embodiment of the device shown in FIG. 3, and illustrates the interaction between the handles of the sack and the handle engaging means of the device.
Figure 5:
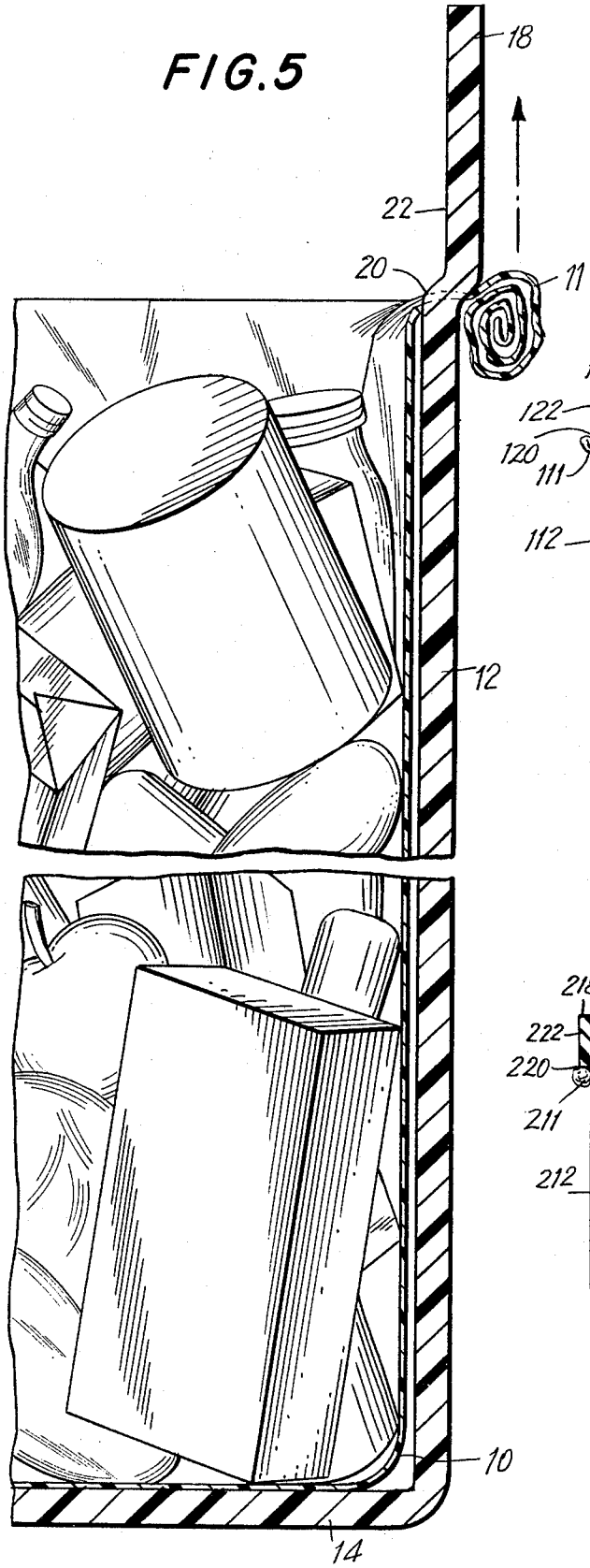
FIG. 5 is a cross-sectional view taken along line 5—5 of FIG. 4.

Illustrated in FIGS. 3–5 is a preferred embodiment of the holding device of this invention. It differs from the device illustrated in FIGS. 1 and 2 primarily by having ears 18 project first outwardly at area 20 and then upwardly at area 22. As is better illustrated in FIGS. 4 and 5, the holding device is designed to permit handles 11 of the plastic sack to seat under the flange created by outwardly projecting area 20 and upwardly projecting area 22 of ears 18. In addition, since the height of the side wall members 12 is slightly less than the height of the plastic sack to be loaded in the device, the gusseted portion of handles 11 also overlie the front edges of the side wall members 20. This construction permits a plastic "T-shirt sack" to be loaded with groceries and allows the filled sack to be easily removed from the device because the cashier can insert several fingers under the handles 11, into area 26 of each side wall member 12, which, along with space 24, forms a single uninterrupted space, and can lift the handles 11 over ears 18 of the device without having to lift the loaded sack off bottom wall 14 until such time that the handles 11 are clear of ears 18 and the filled sack is handed to the purchaser.

Figure 6:
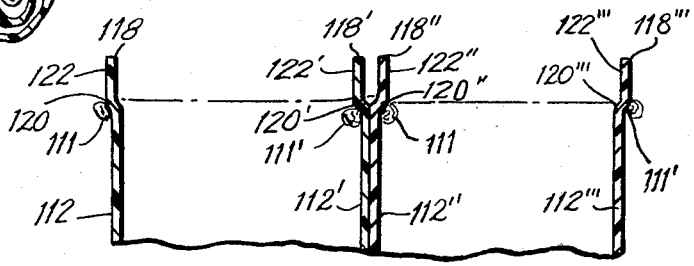
FIG. 6 is a cross-sectional view of an embodiment of the device of the present invention which consists of multiple devices, two in this instance.

FIG. 6 illustrates another embodiment of the present invention. In this embodiment multiple devices (two in this instance) can be provided adjacent each other. As shown therein, the embodiment of FIG. 6 comprises a base wall member (not shown), upwardly projecting side wall members 112, 112', 112'', and 112'''. An upwardly projecting rear wall member (not shown) spans the distance between side wall member 112 and side wall member 112'''. Means to engage the handles 111 and 111' of two plastic sacks are provided. These means comprise ears 118, 118', 118'', and 118'''. It will be noted that the ears of this embodiment of the device project outwardly at areas 120, 120', 120'', and 120''' and then upwardly at areas 122, 122', 122'', and 122'''. This permits the placement of two plastic sacks in the device, and they can be loaded simultaneously. Obviously, a multiple holding device is for use in high volume stores.

In order to permit easy removal of the sack handles, handle 111 of a first sack is placed under the flange created by areas 120 and 122 of ear 118 and the other handle 111 is placed under the flange created by areas 120'', 122'', or ear 118''. The handles 111' of a second sack are placed under the flange created by areas 120', 122' of ear 118', and, thus, over handle 111 of the first sack. The other handle 111 of a second sack is placed under the flange created by areas 120''' and 122''' of ear 118'''.

Figure 7:
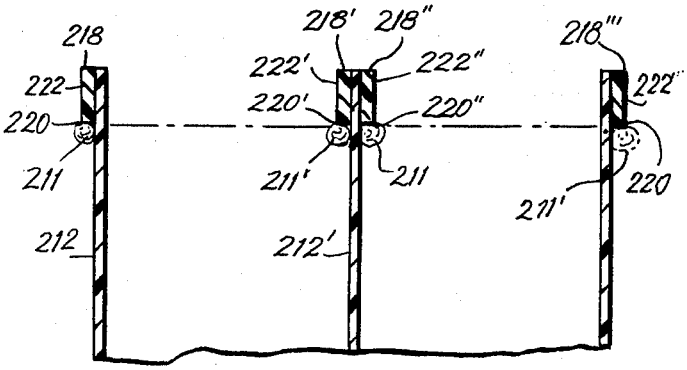
FIG. 7 is a cross-sectional view of an alternate embodiment of the multiple device shown in FIG. 6.

FIG. 7 shows an embodiment similar to that in FIG. 6, except that the outward projections 220, 220', 220'', and 220''' and upward projections 222, 222', 222'', and 222''' are obtained by affixing rigid strips to the appropriate surfaces of upwardly projecting ears 218, 218', 218'' and 218'''. This embodiment operates in the manner described above for the device illustrated in FIG. 6.

Although not shown in FIGS. 6 or 7, each of the side wall members contains a pair of upwardly projecting ears, and these upwardly projecting ears are separated by a space that extends downwardly into each side wall member. The difference between the embodiments illustrated in FIGS. 6 and 7 is that FIG. 6 illustrates an integrally molded device while FIG. 7 illustrates a device which is first molded and then has rigid strips 222, 222', 222'', and 222''' affixed to the appropriate surfaces of ears 218, 218', 218'', and 218'''.

A holding device of this invention may be constructed as follows: the internal perimeter of its base (its width and depth) should be at least equal to or, preferably, slightly larger than the perimeter of the base of the sack to be used therewith, in order to allow the sack to be fully loaded with goods and to support it while it is being filled. On the other hand, the height of the side wall members should be, preferably, slightly less than the height of the body portion of the sack. Thus, as best shown in FIG. 4, when the sack is placed in the holding device, the upper portion of its body is folded over the upper portion of the holding device and the gusseted portion of the handles are folded over the spaced apart ears 18.

In this connection, the dimensions of a device according to FIGS. 1 and 2, which is suitable for "T-shirt" sacks of the one-sixth barrel size, are the following: the height of the rear wall 16 is $17\frac{1}{2}''$; the width of the rear wall 16 is $12\frac{1}{8}''$; the width of each side wall member 12 is $8\frac{1}{4}''$; and the height of each side wall member 12 is $13\frac{1}{4}''$. Since the spaced apart ears 18 are designed to hold the integral sack handles 11 down while the sack is being filled with groceries or other goods, and since they are also designed to allow the easy removal of the filled grocery sack from the device, it has been found that if they are 3" in height, $2\frac{1}{2}''$ in width, and if they are separated by a space $1\frac{1}{2}''$ wide, these goals can be attained.

The dimensions of a device according to FIGS. 3–5, which is suitable for "T-shirt" sacks of the one-sixth barrel size, are the following: the height of the rear wall 16 is $17\frac{1}{4}''$; the width of the rear wall 16 is $11\frac{7}{8}''$; the width of each side wall member 12 is $8\frac{1}{4}''$; the height of each side wall member 12 is $13\frac{1}{4}''$. The spaced-apart ears 18 are 3" in height, $2\frac{1}{2}$ in width, and they are separated by a space $1\frac{1}{2}''$ wide.

The device of this invention can be used as follows: a cashier at the checkout counter takes a sack from a stack of same, opens it and places each handle over the pair of spaced apart ears 18, projecting from the upper edge of each side wall 12. The cashier then proceeds to charge each item by ringing it up on the cash register, or by passing its coded label (with the Universal Product Code printed thereon) over an electronic scanning device, to thereby charge same and by then placing the charged item in the opened sack. When the sack is filled, the cashier inserts his or her fingers into area 26 beneath the handles 11 and then lifts the sack handles over the spaced apart ears 18 thereby avoiding the lifting of the filled package off bottom wall 14 until such time that the sack handles are clear of spaced apart ears 18, and the filled sack can then be handed to the purchaser.

As is obvious, the device of this invention may be manufactured in any size to fit a particular size "T-shirt sack." In addition, it may be constructed of any substantially rigid material, such as plastic, metal, or wood. It has been found, though, that rigid plastic sheets, such as acrylic Plexiglass are suitable.

Generally speaking, the present invention is directed to a device to hold open for loading a limp plastic sack having a pair of integral handles and a body portion terminating in a base portion. It comprises a horizontally disposed base member; a pair of oppositely-disposed, upwardly-projecting side wall members, each of which is attached at its lower end to the base member; an upwardly projecting rear wall member, wherein each vertical edge of the rear wall member is attached to a vertical edge of each of the side wall members; and means to engage the handles of the plastic sack. These means comprise a pair of spaced-apart ears projecting above the upper edges of each of the side wall members, wherein the space between the ears extends downwardly into each of the side wall members. The space between the ears, including the downward extension thereof, is of sufficient width to permit the insertion of several human fingers therein. Preferably, the height of each side wall member is slightly less than the height of the plastic sack to be loaded therein, and the internal perimeter of the base member is at least equal to or slightly greater than the perimeter of the base of the plastic sack when the sack is in an open position ready for loading.

Although the invention has been described above by reference to preferred embodiments, it will be appreciated that other constructions may be devised, which are, nevertheless, within the scope and spirit of the invention and are defined by the claims appended hereto.

What is claimed is:

1. A device to hold open for loading a limp plastic sack having a pair of integral handles and a body portion terminating in a base portion, said device comprising:

(a) a base member;

(b) a pair of side wall members, each attached at its lower end to said base member;

(c) a rear wall member attached to each of said side wall members;

(d) means to engage the handles of said plastic sack, said means comprising a pair of spaced apart ears projecting above the upper edges of each of said side wall members, wherein the space between each of said ears extends downwardly uninterruptedly into each of said side wall members and wherein said space between each of said ears, including said downward extension thereof, is of sufficient width to permit the insertion of several human fingers therein;

wherein the height of said side wall members is slightly less than the height of the plastic sack to be loaded therein and wherein the internal perimeter of said base member is at least equal to the perimeter of the base of said plastic sack when said sack is in an open position and ready for loading.

2. A device as claimed in claim 1, wherein the internal perimeter of said base member is slightly greater than the perimeter of the base of said plastic sack when said sack is in an open position and ready for loading.

3. A device as claimed in claim 4, which is fabricated from a rigid material.

4. A device as claimed in claim 3, wherein said rigid material is a plastic material.

5. A device to hold open for loading a limp plastic sack having a pair of integral handles and a body portion terminating in a base portion, said device comprising:

(a) a horizontally-disposed base member;

(b) a pair of oppositely-disposed, upwardly-projecting side wall members, each attached at its lower end to said base member;

(c) an upwardly-projecting rear wall member, wherein each vertical edge of said rear wall member is attached to a vertical edge of each of said side wall members;

(d) means to engage the handles of said plastic sack, said means comprising a pair of spaced-apart ears projecting above the upper edge of each of said side wall members, wherein the space between each of said ears extends downwardly uninterruptedly into each of said side wall members and wherein said space between each of said ears, including said downward extension thereof, is of sufficient width to permit the insertion of several human fingers therein;

wherein the height of said side wall members is slightly less than the height of the plastic sack to be loaded therein and wherein the internal perimeter of said base member is at least equal to the perimeter of the base of said plastic sack when said sack is in an open position and ready for loading.

6. A device as claimed in claim 5, wherein the internal perimeter of said base member is slightly greater than the perimeter of the base of said plastic sack when said sack is in an open position and ready for loading.

7. A device as claimed in claim 6, which is fabricated from a rigid material.

8. A device as claimed in claim 7, wherein said rigid material is a plastic material.

* * * * *